US006825738B2

(12) United States Patent
Shumovich

(10) Patent No.: US 6,825,738 B2
(45) Date of Patent: Nov. 30, 2004

(54) REDUCED SIZE MICROWAVE DIRECTIONAL COUPLER

(75) Inventor: Raymond J. Shumovich, Roxbury, MA (US)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 10/323,478

(22) Filed: Dec. 18, 2002

(65) Prior Publication Data

US 2004/0119559 A1 Jun. 24, 2004

(51) Int. Cl.[7] ..... H01P 5/18
(52) U.S. Cl. ..... 333/112; 333/116
(58) Field of Search ..... 333/109, 110, 333/112, 115, 116, 117, 118

(56) References Cited

U.S. PATENT DOCUMENTS

| | | | | |
|---|---|---|---|---|
| 4,216,446 A | | 8/1980 | Iwer | |
| 4,375,054 A | | 2/1983 | Pavio | |
| 4,999,593 A | | 3/1991 | Anderson | |
| 5,053,733 A | * | 10/1991 | Oldfield | 333/110 |
| 5,075,646 A | | 12/1991 | Morse | |
| 5,159,298 A | | 10/1992 | Dydyk | |
| 5,243,305 A | | 9/1993 | D'Oro et al. | |
| 5,382,925 A | * | 1/1995 | Hayashi et al. | 333/112 |

FOREIGN PATENT DOCUMENTS

| | | |
|---|---|---|
| EP | 0 354 524 A1 | 2/1990 |
| EP | 0 522 524 A1 | 1/1993 |
| JP | 54049048 | 4/1979 |
| JP | 2001036311 | 2/2001 |
| WO | WO 02/069440 A1 | 9/2002 |

OTHER PUBLICATIONS

Dydyk, Michael, "Microstrip Directional Couplers with Ideal Performance via Single–Element Compensation", IEEE Transactions on Microwave Theory and Techniques, vol. 47, No. 6, Jun. 1999, pp. 956–964.

* cited by examiner

*Primary Examiner*—Robert Pascal
*Assistant Examiner*—Dean Takaoka
(74) *Attorney, Agent, or Firm*—Wolf, Greenfield & Sacks, P.C.

(57) ABSTRACT

A microwave directional coupler includes a first transmission line having an input port and an output port, and a second transmission line having a coupled port and a terminated port. The second transmission line is electromagnetically coupled to the first transmission line. A first capacitor is coupled between the input port and a reference potential, such as ground, a second capacitor is coupled between the output port and the reference potential, a third capacitor is coupled between the coupled port and the reference potential, a fourth capacitor is coupled between the terminated port and the reference potential, and a fifth capacitor is coupled between the output port and the terminated port. The microwave directional coupler has a small size in comparison with prior art directional couplers.

22 Claims, 5 Drawing Sheets

REDUCED SIZE MICROWAVE DIRECTIONAL COUPLER

FIELD OF THE INVENTION

This invention relates to microwave directional couplers and, more particularly, to microwave directional couplers which have a small physical size for a given operating frequency.

BACKGROUND OF THE INVENTION

The demand for a smaller and lower cost components for consumer electronics has increasingly led to efforts to reduce the sizes of various microwave components. An example of such a component is a microwave directional coupler utilized in wireless terminals, such as cellular telephones, for monitoring transmitted power. In such applications, size and weight are critical parameters.

A conventional microwave directional coupler utilizes two 50 ohm transmission lines, each having an electrical length of one quarter wavelength at the operating frequency. The spacing between the transmission lines is selected to provide the desired electromagnetic coupling. At an operating frequency of 1.95 GHz, the length of a conventional microstrip directional coupler is 19 millimeters (mm). This dimension is large in proportion to the overall package size of typical wireless terminals.

Microstrip directional couplers having a capacitor or other reactive element connected between the two transmission lines are disclosed in U.S. Pat. No. 4,216,446, issued Aug. 5, 1980 to Iwer, and U.S. Pat. No. 5,159,298, issued Oct. 27, 1992 to Dydyk. The capacitor or other reactive element is stated to improve the directivity of the directional coupler.

A directional coupler having a capacitor connected between transmission lines and shunt capacitors connected between each transmission line and ground is disclosed in U.S. Pat. No. 5,243,305, issued Sep. 7, 1993 to D'Oro et al. The capacitors are connected at the center of the transmission lines and are stated to increase the directivity of the directional coupler.

A capacitively compensated microstrip directional coupler is disclosed in U.S. Pat. No. 4,999,593, issued Mar. 12, 1991 to Anderson. Reactive coupling networks are coupled between the transmission lines of the directional coupler at each end. Each reactive coupling network includes a first capacitor coupled between a common node and the first transmission line, a second capacitor coupled between the common node and the second transmission line, and a third capacitor coupled between the common node and ground.

All known prior art microwave directional couplers have had one or more drawbacks, including but not limited to unacceptable physical size and a large number of compensation components. Accordingly, there is a need for improved microwave directional couplers.

SUMMARY OF THE INVENTION

According to a first aspect of the invention, a microwave directional coupler is provided. The microwave directional coupler comprises a first transmission line having an input port and an output port, a second transmission line electromagnetically coupled to the first transmission line, the second transmission line having a coupled port and a terminated port, a first capacitor coupled between the input port and a reference potential, a second capacitor coupled between the output port and the reference potential, a third capacitor coupled between the coupled port and the reference potential, a fourth capacitor coupled between the terminated port and the reference potential, and a fifth capacitor coupled between the output port and the terminated port.

The first, second, third and fourth capacitors may have substantially equal values. The reference potential may comprise ground potential.

In some embodiments, the first and second transmission lines comprise microstrip transmission lines. In other embodiments, the first and second transmission lines comprise stripline transmission lines. The first and second transmission lines may comprise coplanar waveguide transmission lines or other transmission lines.

In some embodiments, the first, second, third, fourth and fifth capacitors may comprise lumped capacitors. In other embodiments, the first, second, third, fourth and fifth capacitors may comprise distributed capacitors. The first, second, third and fourth capacitors may each comprise an open circuit stub. The fifth capacitor may comprise a plurality of interdigitated conductors.

According to a further aspect of the invention, a method is provided for microwave directional coupling. The method comprises providing a first transmission line having an input port and an output port, and a second transmission line having a coupled port and a terminated port, positioning the first and second transmission lines for electromagnetic coupling between the transmission lines, coupling a first capacitor between the input port and a reference potential, coupling a second capacitor between the output port and the reference potential, coupling a third capacitor between the coupled port and the reference potential, coupling a fourth capacitor between the terminated port and the reference potential, and coupling a fifth capacitor between the output port and the terminated port.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
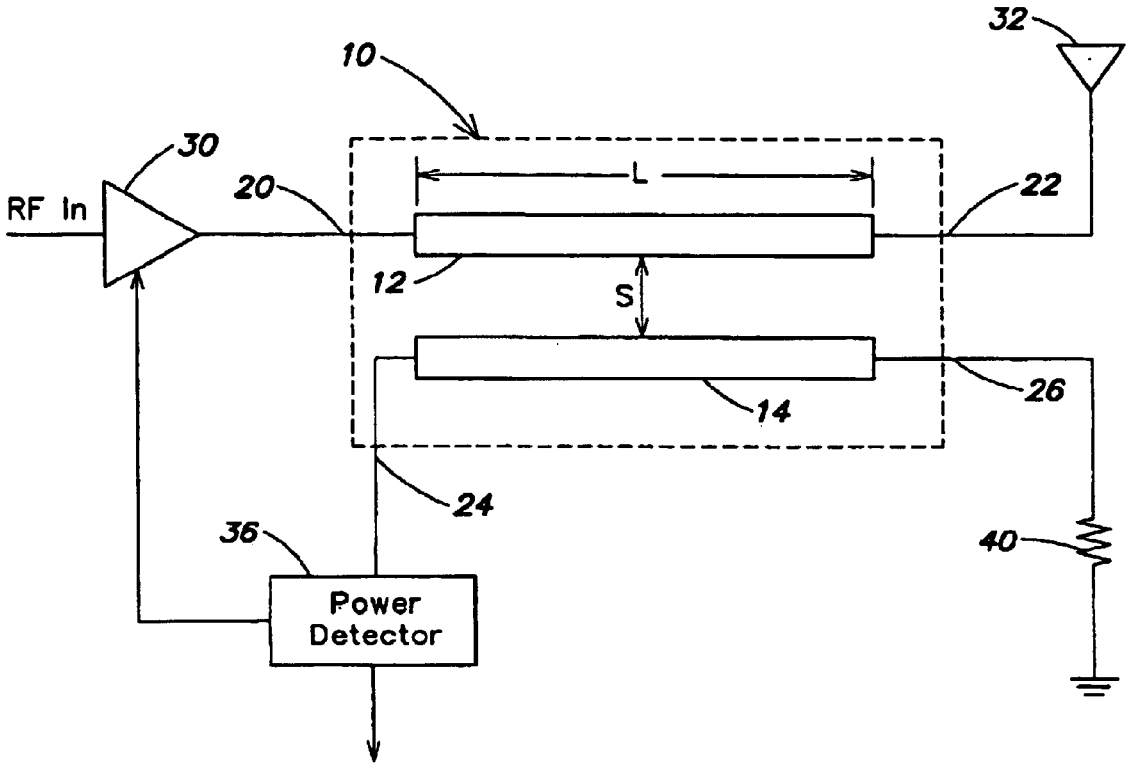
FIG. 1 (Prior Art)
FIG. 1 is a schematic block diagram of a prior art microwave directional coupler in a power monitoring application.

A schematic block diagram of a prior art microwave directional coupler utilized in a power monitoring application is shown in FIG. 1. The microwave directional coupler 10 includes a first transmission line 12 and a second transmission line 14. Transmission lines 12 and 14 may be microstrip transmission lines. Transmission lines 12 and 14 have a length L of one quarter wavelength at the operating frequency and a spacing S that is selected for a desired electromagnetic coupling between transmission lines. Microwave directional coupler 10 includes an RF input port 20 at one end of transmission line 12, an RF output port 22 at the other end of transmission line 12, a coupled port 24 at one end of transmission line 14 and a terminated port 26 at the other end of transmission line 14.

An RF input is coupled through an amplifier 30 to the RF input port 20 of directional coupler 10, and the RF output port 22 is connected to an antenna 32. The coupled port 24 of directional coupler 10 is connected to a power detector 36, and a resistor 40, typically 50 ohms, is connected between terminated port 26 and ground.

In operation, an RF signal is coupled through amplifier 30 and directional coupler 10 to antenna 32 for transmission. A fraction of the transmitted power, typically on the order of about 0.1%, is coupled between transmission lines 12 and 14 and is input to power detector 36. The detected power level is representative of the transmitted power. Power detector 36 thus supplies a signal representative of transmitted power level. The detector signal may be used to control amplifier 30 gain to thereby control transmitted power and may be supplied to other control and monitoring units. As indicated above, the quarter wavelength directional coupler may be unacceptably large for some applications.

Figure 2:
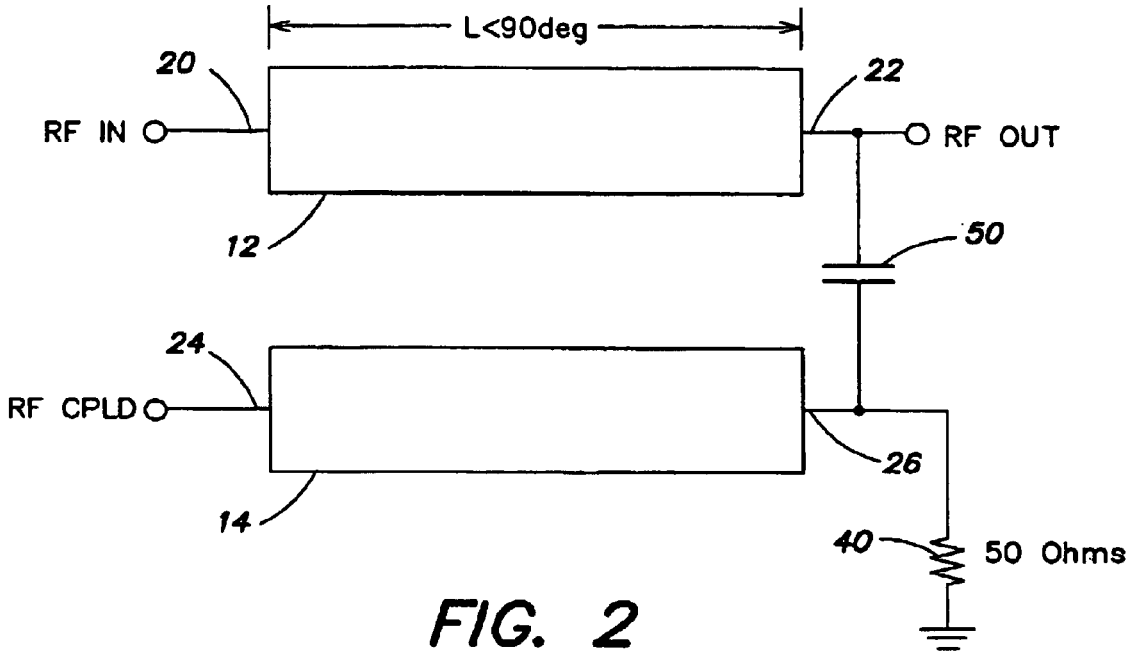
FIG. 2 (Prior Art)
FIG. 2 is a schematic diagram of another prior art microwave directional coupler.

A second prior art microwave directional coupler is shown in FIG. 2. Like elements in FIGS. 1 and 2 have the same reference numerals. In the microwave directional coupler of FIG. 2, a capacitor 50 is connected between output port 22 of transmission line 12 and terminated port 26 of transmission line 14. The configuration of FIG. 2 is disclosed in the aforementioned U.S. Pat. Nos. 4,216,446 and 5,159,298.

Figure 3:
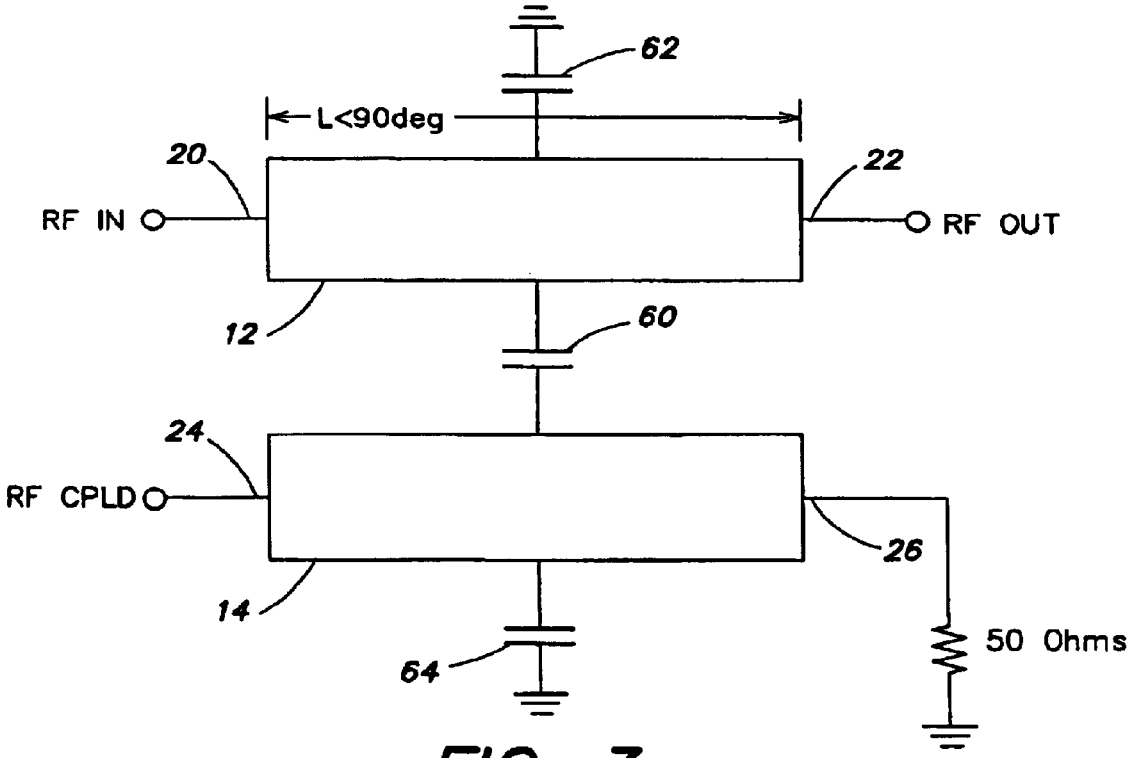
FIG. 3 (Prior Art)
FIG. 3 is a schematic diagram of a further prior art microwave directional coupler.

A third prior art microwave directional coupler is shown in FIG. 3. Like elements in FIGS. 1–3 have the same reference numerals. In the microwave directional coupler of FIG. 3, a capacitor 60 is connected between the center of transmission line 12 and the center of transmission line 14. In addition, a capacitor 62 is connected between the center of transmission line 12 and ground, and a capacitor 64 is connected between the center of transmission line 14 and ground. The microwave directional coupler of FIG. 3 is disclosed in the aforementioned U.S. Pat. No. 5,243,305.

Figure 4:
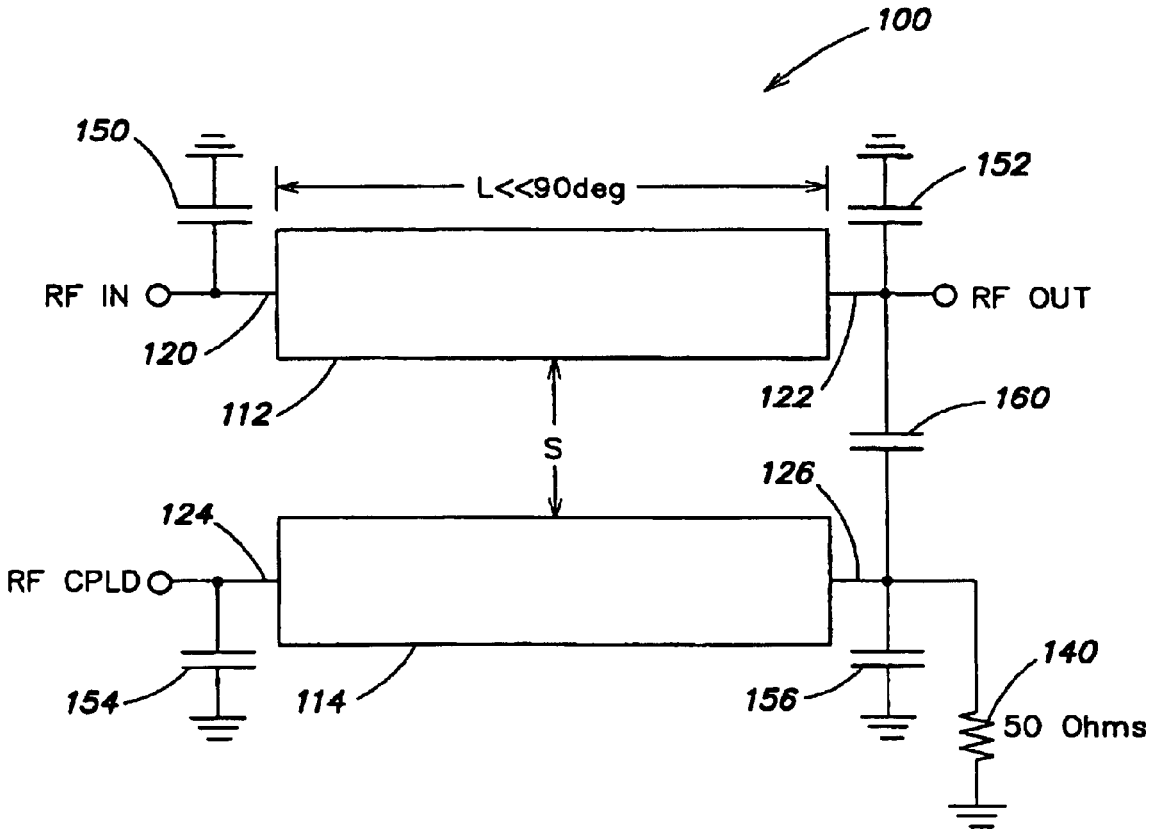
FIG. 4 is a schematic diagram of a microwave directional coupler in accordance with an embodiment of the invention.

A microwave directional coupler 100 in accordance with an embodiment of the invention is shown in FIG. 4. The microwave directional coupler 100 includes a first transmission line 112 and a second transmission line 114. Transmission lines 112 and 114 may be microstrip transmission lines, stripline transmission lines, coplanar waveguide transmission lines or other transmission lines. Transmission lines 112 and 114 may have an operating frequency in a range of about 10 MHz to 100 GHz and in some embodiments may have an operating frequency in a range of about 0.5 to 2 GHz. As discussed below, transmission lines 112 and 114 have a length that is much less than one quarter wavelength at the operating frequency. A spacing S between transmission lines 112 and 114 is selected for a desired electromagnetic coupling between transmission lines. Typically, the spacing S is in a range of about 25 to 250 micrometers.

Microwave directional coupler 100 includes a RF input port 120 at one end of transmission line 112, a RF output port 122 at the other end of transmission line 112, an RF coupled port at one end of transmission line 114 and a terminated port at the other end of transmission line 114. In the embodiment of FIG. 4, input port 120 is adjacent to coupled port 124, and output port 122 is adjacent to terminated port 126. A resistor 140, typically 50 ohms, is connected between terminated port 126 and a reference potential, such as ground.

The microwave directional coupler 100 further includes components which permit a reduction in the size of transmission lines 112 and 114 for a given operating frequency. In particular, a first capacitor 150 is coupled between input port 120 and the reference potential, a second capacitor 152 is coupled between the output port 122 and the reference potential, a third capacitor 154 is coupled between the coupled port 124 and the reference potential, and a fourth capacitor 156 is coupled between the terminated port and the reference potential. The reference potential may be ground or another reference voltage. In an embodiment where transmission lines 112 and 114 have equal dimensions, capacitors 150, 152, 154 and 156 may have equal values. In addition, microwave directional coupler 100 includes a fifth capacitor 160 coupled between output port 122 and terminated port 126. For operating frequencies in a range of about 0.5–2.0 GHz, capacitors 150, 152, 154, 156 and 160 may each have values in a range of about 0.01–0.5 picofarad (pF). The capacitor values depend on the operating frequency of the microwave directional coupler. The capacitors may be lumped capacitors or distributed capacitors.

The microwave directional coupler 100 uses transmission lines 112 and 114 with impedances greater than 50 ohms and lengths L significantly less than one quarter wavelength at the operating frequency. The values of the shunt capacitors 150, 152, 154 and 156, and the transmission line impedances and lengths, are selected to approximately simulate a quarter wavelength transmission line at the operating frequency. By selecting appropriate values of the capacitors and the transmission line impedance, the physical length L of the transmission lines can be significantly reduced. Capacitor 160 connecting the ends of transmission lines 112 and 114 allows the physical length of the transmission lines to be further reduced with minimal impact on coupler directivity.

Figure 5:
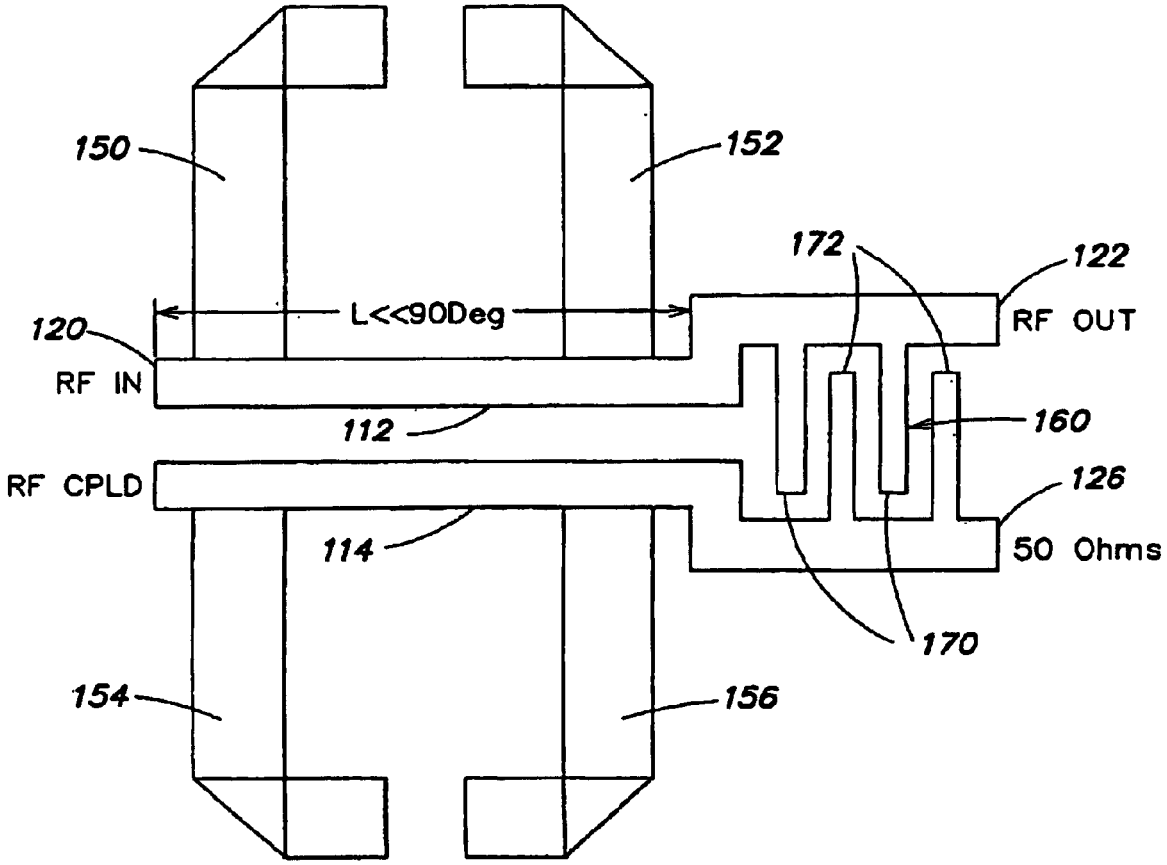
FIG. 5 is a schematic diagram of a microwave directional coupler utilizing distributed capacitors in accordance with an embodiment of the invention.

As noted above, the capacitors 150, 152, 154, 156 and 160 may be in a range of about 0.01–0.5 pF for microwave frequencies. Since it may be difficult to realize these small values with discrete, or lumped, components, distributed capacitors may be utilized. An embodiment of the invention utilizing distributed capacitors is shown in FIG. 5. Like elements in FIGS. 4 and 5 have the same reference numerals. In the embodiment of FIG. 5, shunt capacitors 150, 152, 154, and 156 are implemented as open circuit transmission line stubs. The length and width of the open circuit stub capacitors are selected to provide a desired capacitance. Bends may be incorporated into the open circuit stub capacitors to limit the area of the directional coupler, if desired. In the embodiment of FIG. 5, capacitor 160 is implemented with interdigitated conductors. That is, conductors 170 connected to transmission line 112 are interdigitated with conductors 172 connected to transmission line 114 to form capacitor 160. The number and dimensions of conductors 170 and 172 are selected to provide a desired capacitance at the ends of transmission lines 112 and 114.

For comparison, a prior art microwave coupler design as shown in FIG. 1 and a new coupler design as shown in FIG. 4 were simulated. Both coupler designs used the same substrate and dielectric characteristics. The shunt capacitors 150, 152, 154 and 156 in the embodiment of FIG. 4 had values of 0.1 pF, and capacitor 160 had a value of 0.06 pF. The width of each transmission line was 150 micrometers, and the spacing S between transmission lines was 175 micrometers. The performance of both designs was modeled using a simulation tool known as Momentum, available from Agilent Technologies, Inc.

Table 1 below summarizes the predicted performance and sizes of both designs. The directional coupler examples summarized in Table 1 are designed for WCDMA applications at 1.95 GHz. The simulations indicate that the performance of the embodiment of FIG. 4 is similar to the prior art, but the total length has been reduced by a factor of almost eight, while the total area required has been reduced by a factor of about five.

| RF Performance at 1.95 GHz | Prior Art Coupler Design | New Coupler Design |
|---|---|---|
| Coupling | 22.2 dB | 22.4 dB |
| Insertion Loss | 0.135 dB | 0.06 dB |
| Return Loss | −37 dB | −30 dB |
| Directivity | 22 dB | 32 dB |
| Total Length | 19 mm | 2.4 mm |
| Total Area | 35.2 $mm^2$ | 6.4 $mm^2$ |
| +/− 0.5 dB Coupling Bandwidth | 1.2 GHz/60% | 0.25 GHz/12% |

In addition to the size reduction, the directional coupler of FIG. 4 has significantly lower insertion loss than the prior art directional coupler. The much shorter transmission line length of the directional coupler of the invention more than compensates for the additional losses due to the higher impedances of the lines and the additional capacitors.

Because lumped element matching techniques are utilized, the directional coupler of the invention has a narrower bandwidth than the prior art directional coupler. The directional coupler of the invention provides coupling values of +/−0.5 dB from nominal over a 12% bandwidth, compared to a 60% bandwidth for the prior art directional coupler.

The same directional coupler topology can be used for a variety of applications by selecting different line lengths, line widths and line spacings to obtain a desired coupling value over a frequency band of interest. In addition to the WCDMA example described above, the invention has been utilized to provide reduced size directional couplers for GSM and DCS/PCS applications. The GSM directional coupler provided approximately 30 dB of coupling from 824 to 915 MHz, and had a line length of 1.9 mm, a line width of 100 micrometers and a line spacing of 75 micrometers. The DCS/PCS directional coupler had a nominal coupling value of 27 dB from 1710 to 1910 MHz, and had a line length of 1.275 mm, a line width of 100 micrometers and a line spacing of 75 micrometers. The capacitor values were similar to the values used in the WCDMA example described above. It is noted that both the line spacing and the line length may be varied to achieve a desired coupling between transmission lines.

Figure 6:
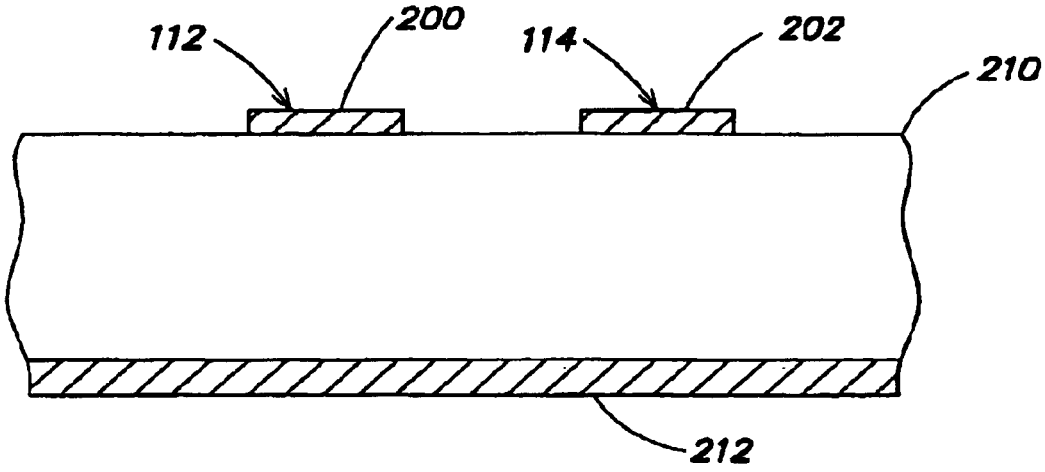
FIG. 6 is a simplified cross-sectional diagram of a microstrip directional coupler.

A microstrip implementation of microwave directional coupler 100 is shown in FIG. 6. It will be understood that the signal conductors of transmission lines 112 and 114 are shown in FIG. 4. As shown in FIG. 6, conductors 200 and 202 of transmission lines 112 and 114, respectively, are formed on an insulating substrate 210. Substrate 210 may be a ceramic or printed circuit board material, typically having a thickness of about 0.001 to 0.025 inch thick. A ground plane 212 is formed on the opposite surface of substrate 210 from conductors 200 and 202. Techniques for a fabricating microstrip transmission lines are well known to those skilled in the art.

Figure 7:
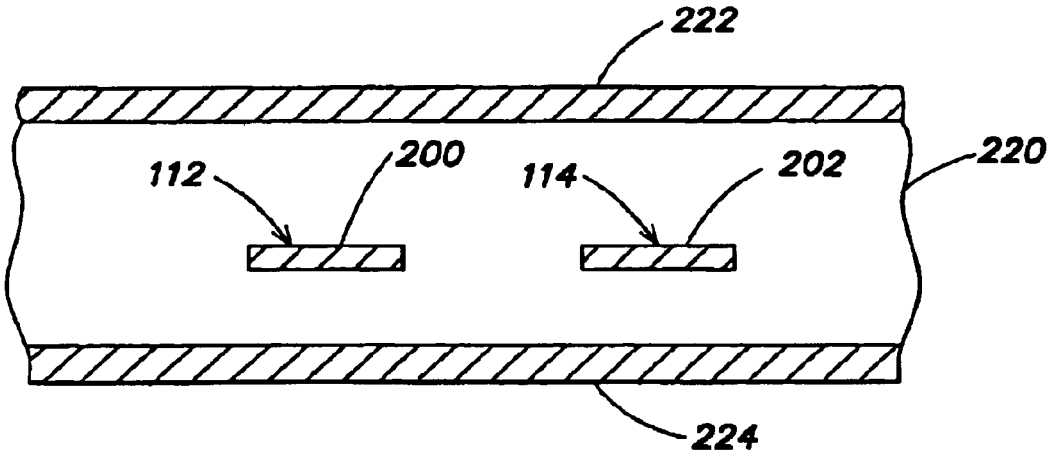
FIG. 7 is a simplified cross-sectional diagram of a stripline directional coupler.

A stripline implementation of microwave directional coupler 100 is shown in FIG. 7. Conductors 200 and 202 of transmission lines 112 and 114, respectively, are embedded in an insulating substrate 220. A ground plane 222 is formed on the upper surface of substrate 220, and a ground plane 224 is formed on the lower surface of substrate of 220. Techniques for the fabrication of stripline transmission lines are well known to those skilled in the art.

The transmission lines 112 and 114 shown in FIGS. 4 and 5 have equal lengths and widths. It will be understood that the invention is not limited in this respect. For example, the individual transmission lines may have different lengths, widths and shapes, and the two transmission lines may have different configurations. In such embodiments, the values of shunt capacitors 150, 152, 154 and 156 are not necessarily equal.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A microwave directional coupler comprising:

a first transmission line having an input port and an output port;

a second transmission line electromagnetically coupled to the first transmission line, said second transmission line having a coupled port and a terminated port, wherein the first and second transmission lines have impedances greater than 50 ohms;

a first capacitor coupled between the input port and a reference potential;

a second capacitor coupled between the output port and the reference potential;

a third capacitor coupled between the coupled port and the reference potential;

a fourth capacitor coupled between the terminated port and the reference potential; and a fifth capacitor coupled between the output port and the terminated port.

2. A microwave directional coupler as defined in claim 1, wherein the first, second, third and fourth capacitors have substantially equal values.

3. A microwave directional coupler as defined in claim 1, wherein the first, second, third, fourth and fifth capacitors comprise discrete capacitors.

4. A microwave directional coupler as defined in claim 1, wherein the reference potential comprises ground potential.

5. A microwave directional coupler as defined in claim 1, wherein the first and second transmission lines comprise microstrip transmission lines.

6. A microwave directional coupler as defined in claim 1, wherein the first and second transmission lines are configured for operation in a frequency range of about 0.5 to 2 GHz.

7. A microwave directional coupler as defined in claim 1, wherein the first and second transmission lines have substantially equal lengths.

8. A microwave directional coupler comprising:

a first transmission line having an input port and an output port;

a second transmission line electromagnetically coupled to the first transmission line, said second transmission line having a coupled port and a terminated port;

a first capacitor coupled between the input port and a reference potential;

a second capacitor coupled between the output port and the reference potential;

a third capacitor coupled between the coupled port and the reference potential;

a fourth capacitor coupled between the terminated port and the reference potential; and a fifth capacitor coupled between the output port and the terminated port, wherein the first, second, third, fourth and fifth capacitors each have values in a range of about 0.01 to 0.5 picofarad.

9. A microwave directional coupler comprising:

a first transmission line having an input port and an output port;

a second transmission line electromagnetically coupled to the first transmission line, said second transmission line having a coupled port and a terminated port;

a first capacitor coupled between the input port and a reference potential;

a second capacitor coupled between the output port and the reference potential;

a third capacitor coupled between the coupled port and the reference potential;

a fourth capacitor coupled between the terminated port and the reference potential; and a fifth capacitor coupled between the output port and the terminated port, wherein the first, second, third, fourth and fifth capacitors comprise distributed capacitors.

10. A microwave directional coupler as defined in claim 9, wherein the first, second, third and fourth capacitors each comprise an open circuit stub.

11. A microwave directional coupler as defined in claim 9, wherein the fifth capacitor comprises a plurality of interdigitated conductors.

12. A microwave directional coupler comprising:

a first transmission line having an input port and an output port;

a second transmission line electromagnetically coupled to the first transmission line, said second transmission line having a coupled port and a terminated port;

a first capacitor coupled between the input port and a reference potential;

a second capacitor coupled between the output port and the reference potential;

a third capacitor coupled between the coupled port and the reference potential;

a fourth capacitor coupled between the terminated port and the reference potential; and a fifth capacitor coupled between the output port and the terminated port, wherein the first and second transmission lines are configured for operation in a frequency range of about 10 MHz to 100 GHz.

13. A microwave directional coupler comprising:

a first transmission line having an input port and an output port;

a second transmission line electromagnetically coupled to the first transmission line, said second transmission line having a coupled port and a terminated port;

a first capacitor coupled between the input port and a reference potential;

a second capacitor coupled between the output port and the reference potential;

a third capacitor coupled between the coupled port and the reference potential;

a fourth capacitor coupled between the terminated port and the reference potential; and a fifth capacitor coupled between the output port and the terminated port, wherein the first and second transmission lines comprise stripline transmission lines.

14. A microwave directional coupler comprising:

a first transmission line having an input port and an output port;

a second transmission line electromagnetically coupled to the first transmission line, said second transmission line having a coupled port and a terminated port;

a first capacitor coupled between the input port and a reference potential;

a second capacitor coupled between the output port and the reference potential;

a third capacitor coupled between the coupled port and the reference potential;

a fourth capacitor coupled between the terminated port and the reference potential; and a fifth capacitor coupled between the output port and the terminated port, wherein the first and second transmission lines comprise coplanar waveguide transmission lines.

15. A method for microwave directional coupling comprising:

providing a first transmission line having an input port and an output port, and a second transmission line having a coupled port and a terminated port;

positioning the first and second transmission lines for electromagnetic coupling between the transmission lines;

coupling a first capacitor between the input port and a reference potential;

coupling a second capacitor between the output port and the reference potential;

coupling a third capacitor between the coupled port and the reference potential;

coupling a fourth capacitor between the terminated port and the reference potential; and coupling a fifth capacitor between the output port and the terminated port, wherein the step of providing first and second transmission lines comprises providing stripline transmission lines.

16. A method for microwave directional coupling comprising:

providing a first transmission line having an input port and an output port, and a second transmission line having a coupled port and a terminated port, wherein the step of providing first and second transmission lines comprises providing transmission lines having impedances greater than 50 ohms;

positioning the first and second transmission lines for electromagnetic coupling between the transmission lines;

coupling a first capacitor between the input port and a reference potential;

coupling a second capacitor between the output port and the reference potential;

coupling a third capacitor between the coupled port and the reference potential;

coupling a fourth capacitor between the terminated port and the reference potential; and coupling a fifth capacitor between the output port and the terminated port.

17. A method as defined in claim 16, wherein the steps of coupling the first, second, third and fourth capacitors comprise coupling first, second, third and fourth capacitors having substantially equal values.

18. A method as defined in claim 16, wherein the steps of coupling the first, second, third and fourth capacitors comprise coupling first, second, third and fourth capacitors to ground potential.

19. A method as defined in claim 16, wherein the step of providing first and second transmission lines comprises providing microstrip transmission lines.

20. A method as defined in claim 16, wherein the steps of coupling the first, second, third, fourth and fifth capacitors comprise coupling discrete capacitors.

21. A method for microwave directional coupling comprising:

providing a first transmission line having an input port and an output port, and a second transmission line having a coupled port and a terminated port;

positioning the first and second transmission lines for electromagnetic coupling between the transmission lines;

coupling a first capacitor between the input port and a reference potential;

coupling a second capacitor between the output port and the reference potential;

coupling a third capacitor between the coupled port and the reference potential;

coupling a fourth capacitor between the terminated port and the reference potential; and coupling a fifth capacitor between the output port and the terminated port, wherein the step of providing first and second transmission lines comprises providing coplanar wave guide transmission lines.

22. A method for microwave directional coupling comprising:

providing a first transmission line having an input port and an output port, and a second transmission line having a coupled port and a terminated port;

positioning the first and second transmission lines for electromagnetic coupling between the transmission lines;

coupling a first capacitor between the input port and a reference potential;

coupling a second capacitor between the output port and the reference potential;

coupling a third capacitor between the coupled port and the reference potential;

coupling a fourth capacitor between the terminated port and the reference potential; and coupling a fifth capacitor between the output port and the terminated port, wherein the steps of coupling the first, second, third, fourth and fifth capacitors comprise coupling distributed capacitors.

* * * * *